United States Patent [19]

Budlane et al.

[11] 4,115,674

[45] Sep. 19, 1978

[54] MOUNTING DEVICE

[75] Inventors: Stanley J. Budlane, Fulton; Dann W. Denny; Ronald L. Hilty, both of Morrison, all of Ill.

[73] Assignee: General Electric Company, Fort Wayne, Ind.

[21] Appl. No.: 677,969

[22] Filed: Apr. 19, 1976

Related U.S. Application Data

[62] Division of Ser. No. 489,841, Jul. 18, 1974, Pat. No. 3,984,650.

[51] Int. Cl.[2] ..... H01H 35/40

[52] U.S. Cl. ..... 200/329; 200/153 LB; 200/83 S; 200/83 R

[58] Field of Search ..... 200/153 LB, 83 R, 83 S, 200/83 SA, 17 R, 83 P, 335; 317/99

[56] References Cited

U.S. PATENT DOCUMENTS

| | | | |
|---|---|---|---|
| 3,200,209 | 8/1965 | Fitzgerald | 200/153 LB |
| 3,493,707 | 2/1970 | Castle | 200/335 |
| 3,549,838 | 12/1970 | Waskowsky | 200/83 WM |
| 3,584,168 | 6/1971 | Halpert | 200/83 S |
| 3,594,521 | 7/1971 | Roll et al. | 200/83 R |
| 3,767,881 | 10/1973 | Sharples | 200/335 X |
| 3,774,000 | 11/1973 | Beer | 200/335 X |

*Primary Examiner*—J. V. Truhe
*Assistant Examiner*—M. Paschall
*Attorney, Agent, or Firm*—Joseph E. Papin

[57] ABSTRACT

A mounting device for a pivotally movable member. The mounting device has means for pivotally mounting the member, means for supporting the mounting means, and a pair of means for abutment with the mounting means so as to generally constrain its movement therebetween. Means for displacement preventing engagement with the mounting means includes means disposed generally in overlaying relation with the mounting means for retaining it against displacement from the supporting means between the abutment means, and means extending through the supporting means into engagement with a portion thereof for maintaining the overlaying relation of the retaining means with respect to the mounting means.

7 Claims, 6 Drawing Figures

MOUNTING DEVICE

CROSS-REFERENCE TO RELATED APPLICATION

This application is a division of parent application Ser. No. 489,841 filed July 18, 1974 (now U.S. Pat. No. 3,984,650 issued Oct. 5, 1976) which is incorporated herein by reference.

BACKGROUND OF THE INVENTION

This invention relates generally to condition responsive electrical devices or switches and in particular to a mounting device for a component of such a device.

In the past, various types of condition responsive electrical devices or switches have been employed in various environments, and one of the most common of these environments was an appliance, such as a washing machine for instance. The past condition responsive electrical switches were generally automatically operable in response to a certain or preselected condition, such as a sufficient reduction in the water level selected for the washing machine, for setting or energizing an electrical circuit for introducing water into the washing machine. When the water attained a selected level in the washing machine, the past condition responsive electrical switch was also generally automatically operable to open a water introducing electrical circuit thereby to terminate the introduction of water into the washing machine and subsequently close another electrical circuit for starting the washing machine. Of course, the condition for effecting such automatic operation of the past condition responsive electrical switches was a differential between the actual water level and an operator selected higher water level, and means were provided for sensing this water level differential to effect the generally automatic operation of the past condition responsive electrical switch. Some of the past condition responsive electrical switches were also provided with operator or manually operated means for overriding the generally automatic operation and resetting the electrical switch thereby to also reset or re-energize the water controlling circuit to again initiate the introduction of additional water into the washing machine.

The manual operation of the past condition responsive electrical switches was effected in several different manners. In some of the past condition responsive electrical switches, a reciprocally movable push rod extended exteriorly of the electrical switch housing for operation by a lever or the like. The push rod was operable generally independently of the other controlling component parts of the condition responsive electrical switch for effecting the resetting thereof and its water controlling circuit. In others of the past condition responsive electrical switches, a manually operable cam was employed to effect the manual resetting operation. The cam was provided with lobes or raised camming or working surfaces between certain positions on the cam for selecting various water levels, and these raised camming surfaces were operable as the cam was manually moved between the certain positions thereof to effect the manual resetting operation of the condition responsive switch either through the component parts thereof or a direct push rod, as previously mentioned.

One of the disadvantageous or undesirable features of some of the past condition responsive electrical switches is believed to be the comparatively large size thereof. This disadvantageous feature is believed to be dictated by an analogous disadvantageous or undesirable feature that the means for automatically driving the past condition responsive electrical switches and sensing water level was necessarily rather large in size so as to be sensitive enough to pneumatically sense the differential between water levels in a washing machine. Still another disadvantageous or undesirable feature of some of the past condition responsive electrical switches is believed to be that an operator applied force for effecting the resetting operation thereof was directed through a coiled compression spring thereby to necessitate rather long travel of the means for effecting the resetting operation.

SUMMARY OF THE INVENTION

Among the several objects of the present invention may be noted that provision of a mounting device which may be utilized in a condition responsive electrical devices or switch or the like; the provision of such mounting device having a component retaining means which is arranged with such switch exteriorly thereof; the provision of such mounting device which enhances a minimum overall size of such switch; the provision of such mounting device in which the component parts are related and mounted with each other so as to occupy a minimum amount of space in such switch; and the provision of such mounting device in which the components parts thereof are, economical to manufacture and easily assembled. Other objects and features of the present invention will be in part apparent and in part pointed out hereinafter.

In general and in one form of the invention, a condition responsive electrical device has a housing, a pivotally movable member therein, and means for pivotally mounting the member. mounting device is provided for the member and includes means including groove means having an open side for supporting and mounting means and a pair of means for abutment with the mounting means so as to generally constrain its movement therebetween. Means removably arranged with the housing for displacement preventing engagement with the mounting means includes means disposed generally in overlaying relation with the mounting means for retaining it against displacement from the supporting means between the abutment means, and means extending through the supporting means and into engagement with a portion thereof for maintaining the overlaying relation of the retaining means with respect to the mounting means.

BRIEF DESCRIPTION OF THE DRAWING

Corresponding reference characters indicate corresponding parts throughout the several views of the drawings.

The exemplifications set out herein illustrate the preferred embodiments of the invention in one form thereof, and such exemplifications are not to be construed as limiting the scope of the disclosure or the invention in any manner.

DETAILED DESCRIPTION OF THE PREFERRED EMBODIMENTS

Figure 3:
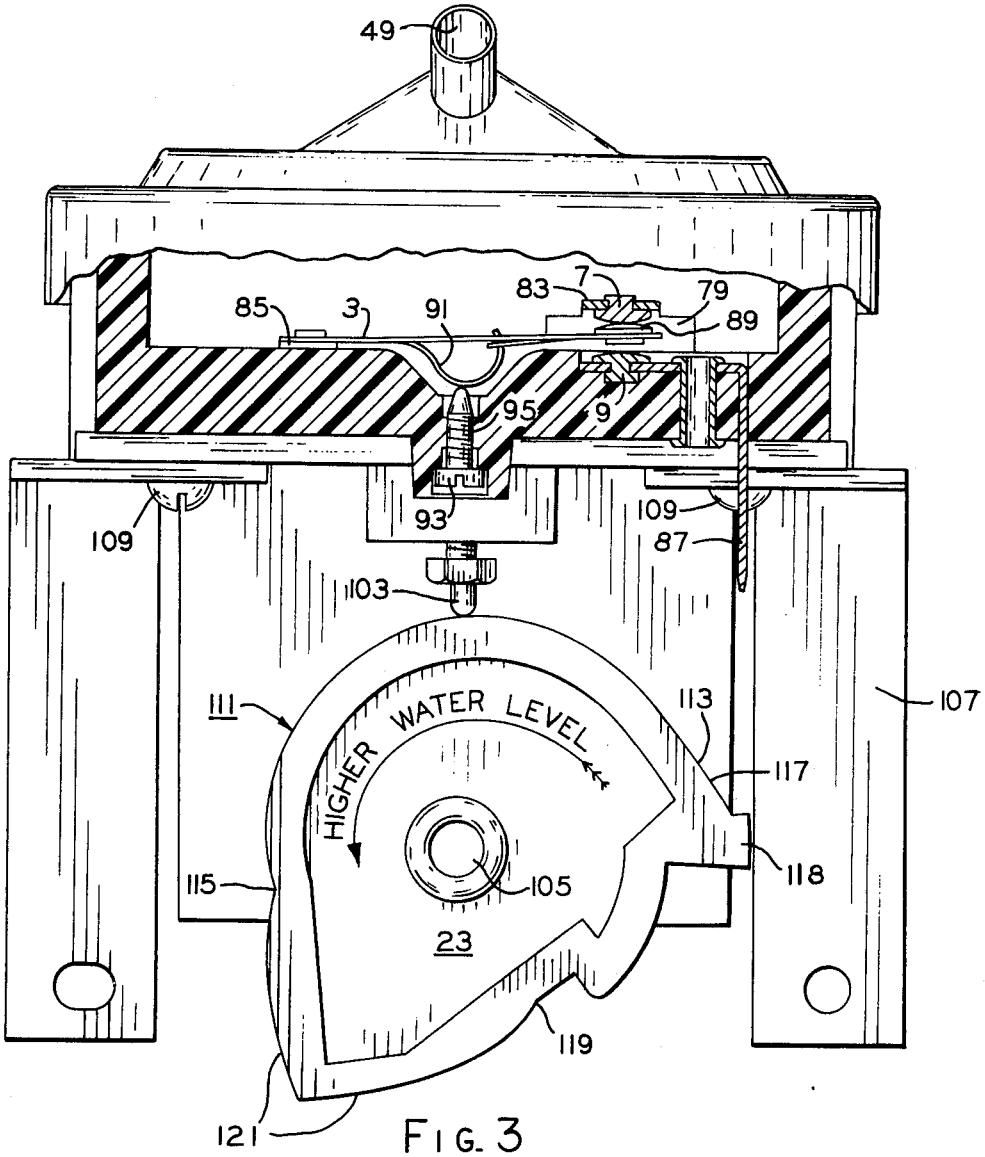
Figure 4:
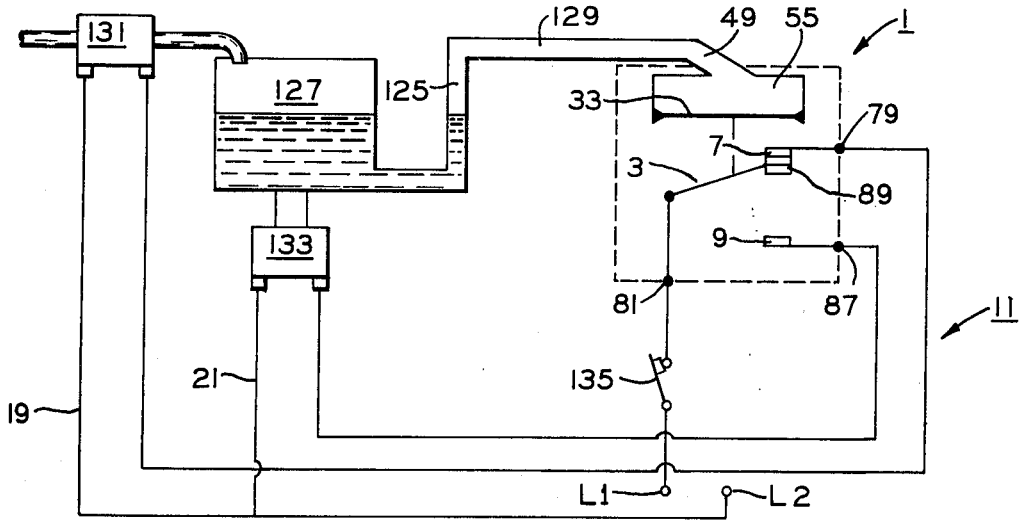
FIG. 4 is a schematic diagram showing the condition responsive electrical switch of FIG. 1 in a control system.

Referring now to the drawings in general, a method is illustrated for operating a condition responsive electrical switch or device indicated generally at 1. Electrical switch 1 is provided with means, such as a resilient switch blade 3 of a switch assembly 5 (FIGS. 1–3), pivotally movable therein between a pair of opposite positions, as defined by a pair of stationary contacts 7, 9 of the switch assembly, for controlling the energization and de-energization of an electrical circuit 11 (FIG. 4). In this method, means, such as a lever 13, is adapted to be conjointly pivotally movable with controlling means or switch blade 3 for effecting actuation thereof between the opposite positions thereof or stationary contacts 7, 9. Means, such as a reciprocally movable plunger 15 or the like, is biased against actuation effecting means or lever 13 for selectively applying a force F1 thereon conjointly urging the lever and switch blade 3 toward one of its opposite positions, i.e., into making engagement with stationary contact 7. Means, such as a diaphragm assembly 17, is driven in response to a certain condition against lever 13 for exerting another force F2 thereon generally opposing force F1 for pivoting the lever and conjointly moving switch blade 3 therewith to the other of its opposite positions, i.e., toward making engagement with stationary contact 9.

Figure 1:
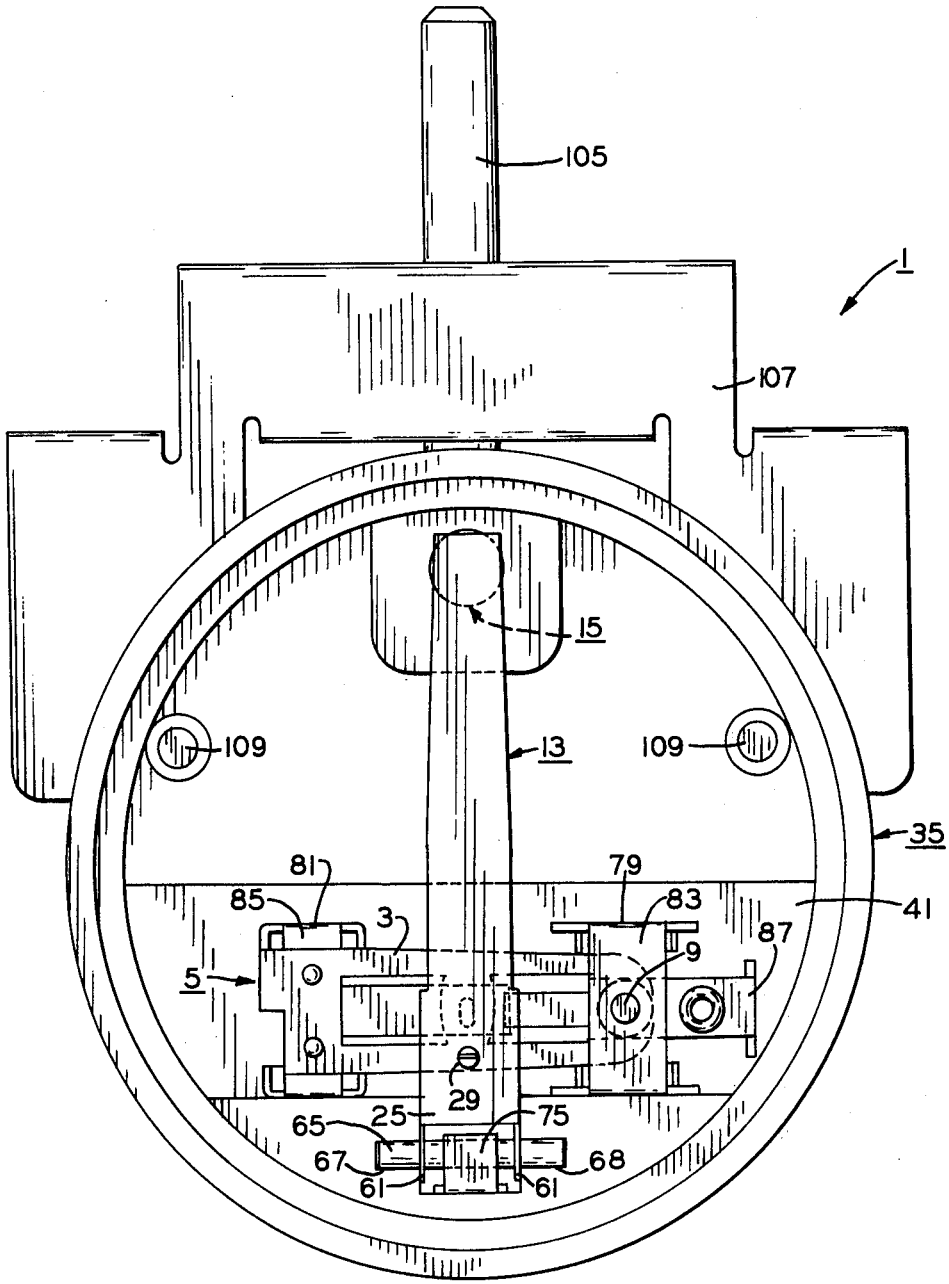
FIG. 1 is a plan view showing a condition responsive electrical switch but having a cover removed for purposes of illustration.
Figure 2:
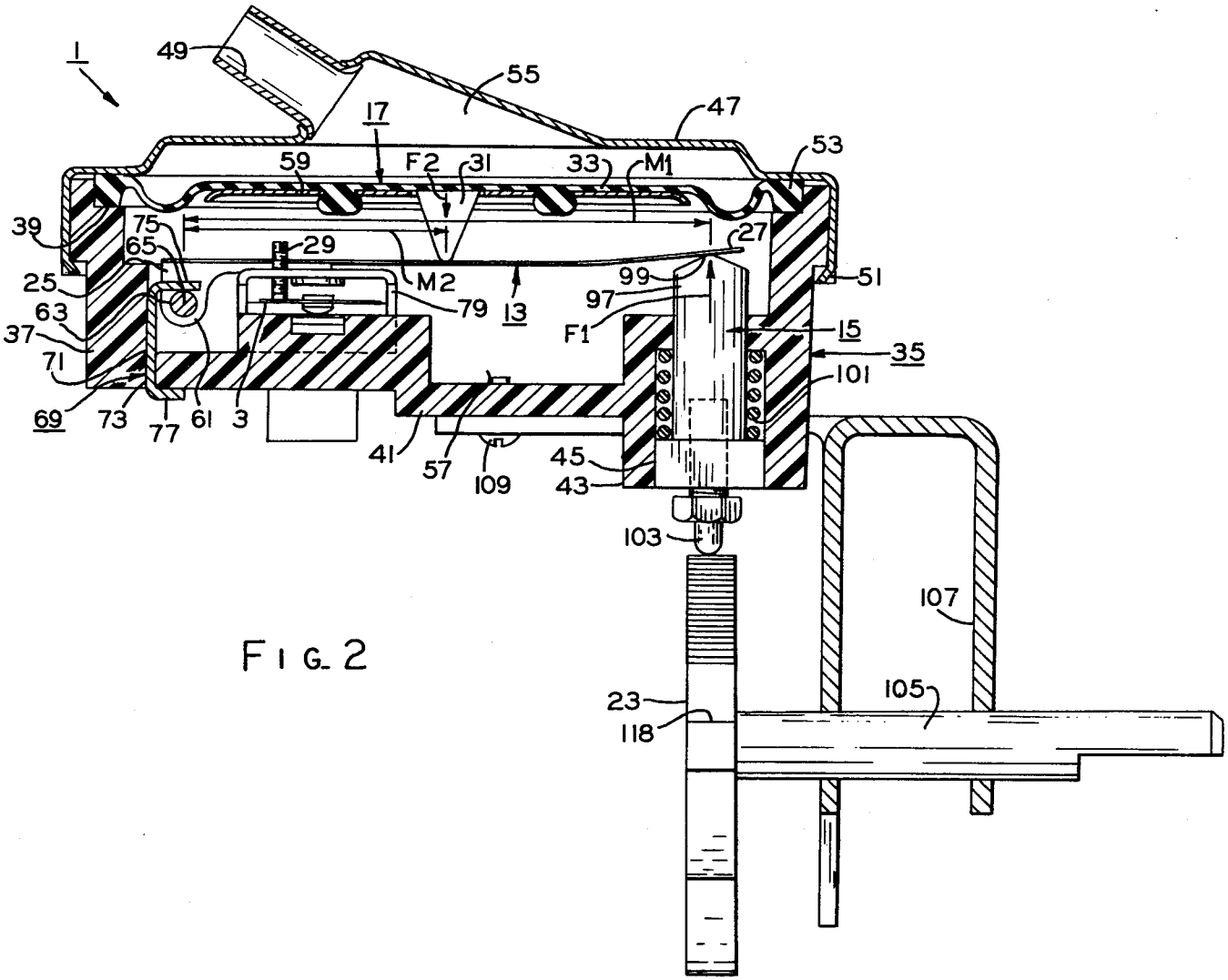
FIG. 2 and 3 are sectional views taken generally along lines 2—2 and 3—3 of FIG. 1.

More particularly and with specific reference to FIG. 4, when switch blade 3 is made with stationary contacts 7, 9, a pair of branches 19, 21 of circuit 11 are set or energized, and these branches are de-energized when the switch blade is disengaged from the stationary contacts, respectively. Of course, electrical switch 1 may be manually reset to effect resetting or energization of branch circuit 19 when switch blade 3 is made with stationary contact 7. Referring also to FIGS. 1–3, in order to effect such resetting, force F1 acting on plunger 15 may be manually and selectively increased for pivoting lever 13 against diaphragm assembly 17 overcoming opposing force F2. In this manner, return movement of switch blade 3 is effected to its one opposite position re-making with stationary contact 7. Of course, the re-making of switch blade 3 with stationary contact 7 need be only momentary to reset or again energize branch 19 of circuit 11. Force F1 may be selectively increased by manually or selectively moving means, such as a rotatable cam 23, for camming plunger 15 against lever 13 between certain positions, as discussed in detail hereinafter, on the cam for overcoming force F2.

Lever 13 has a pivoted end or end portion 25 oppositely spaced from a free end or end portion 27 at least a part of which is resilient. Switch blade 3 and lever 13 are disposed generally perpendicular and in overlaying relation with each other, and pivoted end 25 of the lever is spaced closely adjacent the switch blade. An adjusting stud or member 29 is adjustably mounted to lever 13 closely adjacent pivoted end 25 thereof for driving engagement with switch blade 3. Plunger 15 is selectively biased into engagement with free end 27 of lever 13, and diaphragm assembly 17 has an abutment 31 extending onto driving or abutting engagement with the lever generally adjacent its mid-portion and on a side thereof opposite the plunger. In this manner, force F1 is applied by plunger 15 onto lever 13 and is oppositely directed with respect to force F2 exerted on the lever through diaphragm assembly 17.

Adjusting stud 29 is disposed in driving engagement with switch blade 3, as mentioned above, and is predeterminately spaced closer to pivoted end 25 of lever 13 than the engagement of diaphragm assembly extension 31 with the lever so that the distance of the lever arm from adjusting stud 29 to pivoted end 25 is predeterminately less than that between the pivoted end and the engagement of the diaphragm assembly extension with the lever. Therefore, it may be noted that lever 13 is operable generally to magnify the effects of force F2 generally about pivoted end 25 of the lever with respect to the driving engagement of adjusting stud 29 with switch blade 3. Due to this magnification of the action of diaphragm assembly 17 on adjusting stud 29 in lever 13, it may be further noted that the size or diameter of a diaphragm 33 utilized in the diaphragm assembly may be predeterminately maintained to a minimum. From the foregoing, it may also be noted that the spring gradient of lever 13 may be superimposed upon that of switch blade 3 upon the deflection of free end 27 of the lever in response to the application of force F1 thereon by plunger 15.

Referring now again to FIGS. 1–3 in general, electrical switch 1 is provided with a housing 35, and means, such as switch blade 3, is movable in the housing between opposite positions generally defined by stationary contacts 7, 9 for controlling the flow of power through electrical switch 1. Means, such as lever 13, is pivotally movable in housing 35 for effecting actuation of controlling means or switch blade 3 between its opposite positions, and means, such as diaphragm assembly 17, is operable generally in response to a certain condition for driving actuation means or lever 13 to pivot it and conjointly move the switch blade toward its one opposite position, i.e., to make with stationary contact 9. Means, such as plunger 15, is selectively operable for biasing lever 13 against driving means or diaphragm assembly 17 to also pivot the lever and effect conjoint movement of switch blade 3 toward its other opposite position, i.e., to make with stationary contact 7.

More particularly and with specific reference to FIGS. 1 and 2, housing 35 is provided with a generally annular side wall 37 having a diaphragm receiving seat or annular recess 39 in the upper end thereof, and the side wall is integrally formed with a stepped lower end or base wall 41. A plunger receiving hub 43 is integrally formed on base wall 41 generally perpendicular thereto, and a stepped bore 45 extends through the hub. Housing 35 also includes a closure member or cover 47 having a port 49 therein. Cover 47 is disposed on the free or upper end of side wall 37, and means, such as a plurality of staked fingers 51 or the like, are provided in the cover for securing it to the side wall.

Diaphragm assembly 17 is provided with resilient, flexible diaphragm 33, as previously mentioned, and a peripheral bead 53 on the diaphragm is sealably retained in recess 39 between housing side wall 37 and cover 47. Diaphragm 33 generally divides housing 35 into an upper or fluid pressure chamber 55 and a lower or switch chamber 57. A push plate 59 is carried on the lower side of diaphragm 33 within switch chamber 57, and abutment 31 is lanced from the push plate serving as a means for transmitting force F2 from diaphragm assembly 17 to lever 13. As previously mentioned, abutment 31 engages lever 13 generally adjacent the mid-portion thereof.

Figure 5:
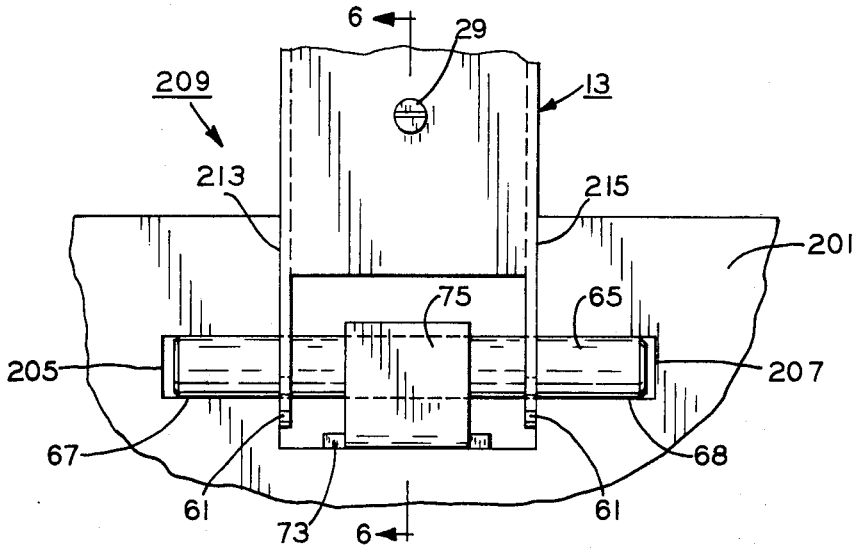
FIGS. 5 and 6 are greatly enlarged fragmentary views taken from FIGS. 1 and 2, respectively, showing a mounting device in one form of the invention.
Figure 6:
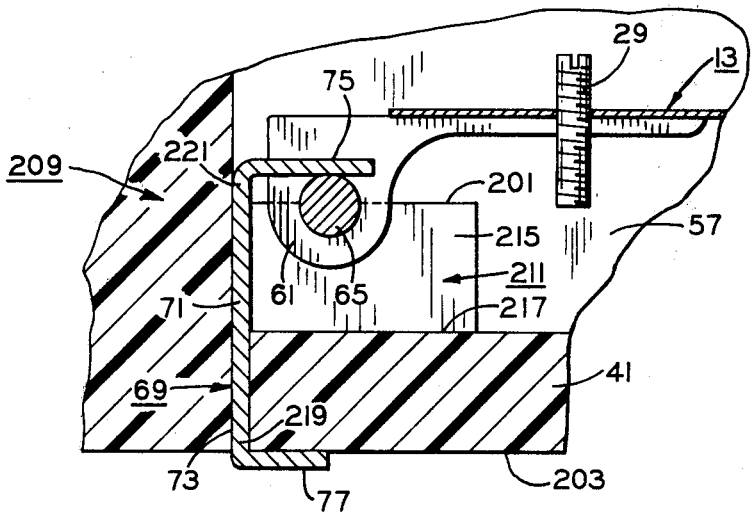

Lever 13 may be formed from a resilient metal, such as a relatively thin sheet of spring steel or the like, and is generally elongate in shape. Lever 13 extends generally parallel to housing base wall 41 diametrically across switch chamber 57 having its pivoted and free ends 25, 27 adjacent opposite portions of housing side wall 37. As best seen in FIGS. 5 and 6, a pair of spaced depending mounting legs 61 are integrally provided on lever 13 at pivoted end 25 thereof, and a pair of aligned openings or apertures 63 are provided in the legs. Leg openings 63 are pivotally received on a pivot pin or shaft 65 which, in turn, is received in a pair of oppositely spaced trunnion grooves or groove means 67, 68 provided in housing base wall 41 adjacent the leftward side thereof. Means, such as a generally U-shaped retainer 69, is provided for retaining pivot pin 65 against displacement from trunnion grooves 67, 68. Retainer 69 is provided with a generally straight base portion 71 which extends through a slot 73 provided therefore in housing base wall 41, and a pair of spaced tabs 75, 77 integral with the base portion extend therefrom into overlaying relation with pivot pin 65 and an exterior portion of the housing base wall adjacent slot 73. Adjusting stud 29 is threadedly or adjustably received in lever 13 adjacent its pivoted end 25 for driving engagement with switch blade 3, as previously mentioned, and adjusting movement of the adjusting stud is provided to compensate for tolerance variance with respect to the forming and mounting of lever 13 and switch blade 3 within switch chamber 57.

Switch assembly 5 includes a pair of laterally spaced apart terminals 79, 81 (as seen in FIG. 1) each having bridging portions 83, 85 within switch chamber 57 as well as portions extending through housing base wall 41 exteriorly of housings 35 for connection in electrical circuit 11, as described hereinafter. Stationary contact 7, FIG. 3, is riveted or otherwise secured to terminal bridging portion 83 generally in vertically spaced relation with respect to stationary contact 9 which is riveted or otherwise connected to another terminal 87. Terminal 87 is riveted or otherwise secured to housing base wall 41 and has a portion extending therethrough exteriorly of housing 35 also for connection in circuit 11. As previously mentioned, switch blade 3 is disposed generally perpendicular to lever 13 and closely adjacent pivoted end 25 of the lever, and blade 3 may be formed from a metal having good electrical conducting characteristics, such as copper or the like, and is also generally elongate in shape, FIGS. 1 and 3. One end of switch blade 3 is riveted or otherwise secured to bridging portion 85 of terminal 81, and the other or opposite end of the switch blade carries a movable or double contact 89 which is movable between stationary contacts 7, 9 for making and breaking engagement therewith. Switch blade 3 is also integrally provided with a toggle spring 91 to effect snap-action thereof and normally urges the switch blade toward an over-center position making movable contact 89 with stationary contact 7. Means, such as an adjusting screw 93, is threadedly or adjustably received in a cooperating aperture or opening 95 provided therefor in housing base wall 41. Adjusting screw 93 is operable generally for abutting toggle spring 91 to adjust the tension thereof and the force necessary for effecting snap-action movement of switch blade 3 between stationary contacts 7, 9. It may be noted that adjusting stud 29 carried on lever 19 drivingly engages switch blade 3 at a point generally offset from the center line thereof. Such offset engagement imparts a rocking or rolling motion to switch blade 3 upon actuation thereof so as to, in effect, rock or roll movable contact 89 into making and breaking engagement with stationary contact 7, 9 to generally negate contact welding thereby to enhance the operating life thereof.

In FIG. 2, it may be seen that plunger 15 is slidably or reciprocally received in stepped bore 45 of housing hub 43, as previously mentioned, and an extension 97 of the plunger extends into switch chamber 57 having a free end or abutment 99 for engagement with lever 13 adjacent free end 25 thereof. A return spring 101 is contained between plunger 15 and the shoulder on housing 35 between stepped bore 45, and the compressive force of the return spring urges plunger 15 away from its engagement with lever 13. Another adjusting screw or cam follower 103 is threadedly or adjustably received in the exterior end of plunger 15 for adjusting the tension on return spring 101 and is normally urged thereby into following engagement with cam 23.

Cam 23 is attached by suitable means (not shown) to an end of a selectively operable or manually rotatable shaft 105, and the shaft is rotatably mounted in a mounting bracket 107 for electrical switch 1. Mounting bracket 107 is secured by suitable fastening means, such as a plurality of screws 109, to an exterior portion of housing base wall 41. Cam 23 is provided with a peripheral camming surface 111, into which cam follower 103 is biased by plunger return spring 101. As best seen in FIG. 3, camming surface 111 is generally eccentric between setting points 113, 115 with respect to shaft 105, and a reset surface 117 is provided between point 113 and a stop or ear 118 extending from the cam. Reset surface 117, is so eccentric with respect to shaft 105 as to effect reciprocal movement of plunger 15 to its resetting position, as discussed hereinafter. Also between point 115 and a mini-wash detent 119 on cam 23, another reset surface 121 is provided and elevated with respect to shaft 109 so as to also effect movement of plunger 15 to its resetting position. To complete the description of electrical switch 1, it may be noted that the provision of resetting surfaces, such as at 117, 121 on cam 23, which are operable upon movement thereof between certain camming positions to effect resetting actuation of the electrical switch, is generally well known in the art.

Referring again to the drawings in general, there is shown at 123 (FIG. 4) a control system having means, such as switch blade 3, movable for switching action between certain electrical operating modes, and means, such as lever 13, is adapted to be pivotally movable for effecting actuation of the switching means or switch blade 3 between its modes (FIGS. 1-3). A source of fluid pressure 125 is provided (FIG. 4), and means, such as a diaphragm assembly 17, is responsive to the fluid pressure of the source for driving the actuation effecting means or lever 13 to effect its pivotal movement and conjointly therewith movement of the switching means toward one of its modes. Means, such as plunger 15, is provided for biasing lever 13 against the driving means or diaphragm assembly 17 generally in a direction to effect movement of the switch blade 3 toward another of its modes. Means, such as cam 23, is selectively operable between at least certain positions for altering the bias of plunger 15 on lever 13.

More particularly, there is shown in FIG. 4 a container, such as a tub 127 of a washing machine (now shown) for instance, and a conduit 129 is connected in pressure fluid communication between the lower end of the tub and port 49 of electrical switch 1 partially schematically shown within the dotted box in FIG. 4. As will be recalled, port 49 communicates with fluid pressure chamber 55 of electrical switch 1. Of course, the particular level of water in tub 127 will also be reflected as the level of water in conduit 129. As the water level rises and falls in tub 127 and conduit 129 during a washing operation of the washing machine, air trapped in the conduit and fluid pressure chamber 55 of electrical switch 1 is compressed and expanded. In effect, the air trapped in conduit 129 by water in tub 127 and conduit 129 generally constitutes fluid pressure source 125. A solenoid actuated valve 131 of a type well-known in the art is provided to control the introduction of wash water into tub 127, and an electric motor 133 is provided for driving the washing machine. With respect to electrical circuit 11, terminal 81 of electrical switch 1 is connected with terminal L1 of a pair of power or line terminals L1, L2, and an on-off type operator controlled, single pole, single throw switch 135 is connected in the circuit between line terminal L1 and terminal 81 of electrical switch 1. Branch circuit 19 of electrical circuit 11 connects solenoid valve 131 across power terminal L2 and terminal 79 of electrical switch 1, and branch circuit 21 connects motor 133 across power terminal L2 and terminal 87 of the electrical switch. In one of its electrical operating modes, switch blade 3 may be made with stationary contact 7 of electrical switch 1 for energizing branch circuit 19 to effect energization of solenoid valve 131 for effecting the introduction of water into tub 127. In another of its electrical operating modes, switch blade 3 may be made with stationary contact 9 of electrical switch 1 for energizing branch circuit 21 to effect energization of motor 133 for driving the washing machine. To complete the description of system 123, the switching action of switch blade 3 between its certain or one and other electrical operating modes, as discussed above, is only effective in circuit 11 when on-off switch 135 is closed thereby to make the circuit across power terminals L1, L2.

Operation

In the operation, assume that an operator has selectively operated or manually rotated cam 23 through its shaft 105 from low camming position or setting 115 on camming surface 111 to the higher or more eccentric camming position or setting shown in FIG. 3. In response to this camming movement, cam follower 103 and plunger 15 are urged or biased generally upwardly in housing stepped bore 43 against the compressive force of return spring 101 to bias abutment 99 of plunger extension 97 into engagement with free end 27 of lever 13, FIG. 2. In this manner, plunger 15 selectively applies force F1 onto lever 13 deflecting free end 27 thereof, and force F1 tends to pivot the lever about its pivoted end 25 against abutment 31 of diaphragm assembly 17. The moment M1 of force F1 acting generally about lever pivoted end 25 generally reflects or designates the operator selected water level in tub 127, as discussed in greater detail hereinafter.

With the water lever so selected, the operator may now close starting switch 135, as shown in FIG. 4. When movable contact 89 of switch blade 3 is made with stationary contact 7 of electrical switch 1, closure of starting switch 135 effects energization of branch circuit 19 from power terminal L1 through the closed starting switch, terminal 81, switch blade 3 and terminal 79 of the electrical switch and across solenoid valve 131 to power terminal L2. In this manner, energization of branch conduit 19 effects concerted energization of solenoid valve 131 to initiate the introduction of water into tub 127.

As the water level in tub 127 and conduit 129 rises, the air trapped in the conduit and chamber 55 of electrical switch 1 is thereby compressed increasing the fluid pressure thereof generally commensurately with the rise or height of the water level. This increasing fluid pressure in chamber 55 acts on the effective area of diaphragm 33 therein to establish force F2 which is transmitted through diaphragm plate 59 and abutment 31 onto lever 13 generally in opposition to force F1 acting thereon, FIG. 2. The moment M2 of force F2 acting generally about lever pivoted end 25 is, of course, oppositely directed with respect to moment M1. As the water level in tub 127 and conduit 129 reaches the height selected by operator operation of cam 23, as previously mentioned, the increasing fluid pressure in the conduit and chamber 55 effects a corresponding increase in force F2 and moment M2. When the water level rises to its selected height, moment M2 is increased to a value overcoming that of moment M1. At this time, moment M1 effects pivotal movement of lever 13 about its pivoted end 25, and such pivotal movement is transmitted or translated through adjusting stud 29 to switch blade 3 effecting generally conjoint pivoted or driving movement thereof against the force of toggle spring 91. When switch blade 3 is so pivotally moved or driven past its overcenter position it then, with characteristic snap action, disengages or breaks movable contact 89 from stationary contact 7 and moves the movable contact into making engagement with stationary contact 9.

Of course, when movable contact 89 breaks from stationary contact 7, branch circuit 19 is opened or de-energized thereby to effect de-energization of solenoid valve 131 which terminates further introduction of water into tub 127. Further, the making engagement of movable contact 89 with stationary contact 9 effects energization of branch circuit 21 from power terminal L1 through closed starting switch 135, terminal 81, switch blade 3, movable contact 89 which is made with stationary contact 9, terminal 87 of electrical switch 1 and across motor 133 to power terminal L2. In this manner, the energization of branch circuit 21 effects energization of motor 133 for driving the washing machine (not shown). From the foregoing, it may be noted that lever 13 is operable generally to magnify the affects forces F1, F2 applied thereto with respect to the force transmitted by lever 13 through adjusting stud 29 to switch blade 3, as previously mentioned.

If an increase in the water level is desired, the operator selectively operates or manually rotates cam 23 in a counterclockwise direction (as seen in FIG. 3) until stop 118 engages cam follower 103, and such engagement insures that the cam follower is disposed on reset portion or surface 117 of peripheral camming surface 111. This engagement of resetting surface 117 with cam follower 103 effects the conjoint movement of it and plunger 15 further upwardly (as seen in FIG. 2) against lever 13 a distance predeterminately great enough to increase moment M1 to a value insured to overcome that of moment M2 thereby to initiate resetting operation of electrical switch 1.

During the resetting operation, lever 13 is pivotally moved about its pivoted end 25 (as seen in FIG. 2) in response to the resetting value of moment M1 thereby to conjointly urge diaphragm assembly 17 generally upwardly. In this manner, resetting pivotal movement of lever 13 alleviates the force exerted by lever 13 through adjusting stud 29 on switch blade 3 to effect resetting actuation thereof. When the force of lever 13 on switch blade 3 is alleviated, the compressive force of toggle spring 91 then effects resetting actuation of switch blade 3 moving it generally in a counterclockwise direction (as seen on FIG. 3) past its overcenter position with characteristic snap-action breaking engagement of movable contact 89 with stationary contact 9 and making engagement of the movable contact with stationary contact 7. As previously discussed, such breaking of contact 9, 89 opens branch circuit 21 thereby to de-energize motor 133, and such making of contacts 7, 89 again closes branch circuit 19 thereby to again energize solenoid valve 131 and establish the introduction of water into tub 127.

With electrical switch 1 now reset, as discussed above, the operator selectively operates cam 23 to a setting position establishing or effecting a higher water level in tub 127. To actuate cam 23 to its selected higher water level position, the operator rotates the cam in a clockwise direction (as seen in FIG. 3) disengaging resetting surface 117 thereof from can follower 103 and repositioning camming surface 111 at a selected position between high and low water level positions 113, 115 thereon which establishes the selected higher water level for tub 127. Upon this selective rotation of cam 23 to its selected higher water level position, return spring 101 moves plunger 15 downwardly (as seen in FIG. 2) in housing stepped bore 43 to maintain cam follower 103 in following engagement with camming surface 111. This downward movement of plunger 15, of course, decreases the value of moment M1 on lever 13 permitting it to reposition or pivotally move about its pivoted end in response to moment M2; however, at this time, the repositioning of the lever does not effect switching action or movement of switch blade 3.

When the water introduced into tub 127 by solenoid valve 131 upon the resetting operation of electrical switch 1 attains the higher level selected by the operator, the air trapped in conduit 129 is compressed to a greater degree thereby to commensurately increase the fluid pressure in the conduit 129 and chamber 55 of the electrical switch. Of course, this increased fluid pressure attained in response to the selected higher water level in tub 127 effects a corresponding increase in force F2 and moment M2 to a value great enough to overcome moment M1. In response to this increased value of moment M1, lever 13 is pivotally moved about its pivoted end 25 in the clockwise direction (as seen in FIG. 2) to effect actuation of switch blade 3. This pivotal movement of lever 13 is translated through adjusting stud 29 to switch blade 3 transmitting thereto a force for pivotally moving the siwtch blade in the clockwise direction (as seen in FIG. 3) against toggle spring 91. When switch blade 3 is so pivoted to its overcenter position, toggle spring 91 effects movement or the switching action of the switch blade with characteristic snap-action breaking engagement of movable contact 89 with stationary contact 7 and making engagement of the movable contact with stationary contact 9. As previously mentioned, breaking engagement of contacts 7, 89 opens branch circuit 19 thereby to de-energize solenoid valve 131 terminating the introduction of water into tub 127 when the level of water therein attains the level preselected by the operator. Making engagement of contacts 9, 89 closes branch circuit 21 thereby to re-energize motor 133 for restarting the washing machine (not shown).

The operator can effect further selected increases of the water level in tub 127 by effecting further resetting operations of electrical switch 1 in the same manner as described hereinabove. However, the resetting operation of electrical switch 1 is only effective to increase the water level to a height in excess of that then currently being employed in tub 127. In other words, reducing the water level to a selected lower level may be accomplished by draining water from tub 127 of the washing machine and then operating condition responsive electrical switch 1 in the manner described above to effect refilling of the washing machine with water to the aforementioned selected lower level. Of course, circuit 11 disclosed for illustrating the operation of electrical switch 1 and control system 123 of this invention has, for the sake of brevity, been simplified and does not include circuitry and means for controlling a wash cycle of the washing machine or draining the water therefrom.

The lowest water level for tub 127 which can be attained by operation of electrical switch 1 is denoted by mini-wash detent 119, and this mini-wash water level is lower than any wash level which may be attained by setting camming surface 111 between positions 113, 115 thereon in engagement with cam follower 103, as discussed hereinabove. If cam 23 is selectively rotated in the clockwise direction (as seen in FIG. 3) by the operator from a higher water level setting thereof to engage detent 119 with cam follower 103 during a washing cycle of the washing machine, it is, of course, necessary to first engage resetting surface 121 with the cam follower. The translation of resetting surface 121 across cam follower 103 is, in effect, generally instantaneous, and the resetting function of the component parts of electrical switch 1, as described above, is effected generally instantaneously. However, the very quick or instanteous movement of switch blade 3 to effect the making and breaking of movable contact 89 between stationary contact 7, 9 results in a very quick pulsing type opening and closing of branch circuits 19, 21 with an accompanying pulsing type de-energization and energization of motor 133 and solenoid control valve 131. Of course, it is apparent that such pulsing or instantaneous type energization and de-energization of solenoid control valve 131 and motor 133 is much too quick to initiate the respective function thereof, i.e., in effect, water is not introduced into tub 127 and the washing machine does not stop. As detent 119 is so rotated to setting engagement with cam follower 103, return spring 101 conjointly moves plunger 15 and the cam follower in the downward direction (as seen in FIG. 2.) Of course, such downward movement of plunger 15 in housing stepped bore 43 decreases force F1 and moment M1 thereby to increase the differential between moments M1, M2 acting through lever 13. In this manner, the differential of moments M1, M2 merely results in increasing the force transmitted through lever 13 to switch blade 3 to urge movable contact 89 into making engagement with stationary contact 9.

When the then current washing cycle of the washing machine terminates the wash water is drained from tub 127, the air trapped in conduit 129 is communicated with atmosphere thereby to eliminate the fluid pressure in chamber 55 of electrical switch 1 acting on diaphragm 33 as well as force F2 and moment M2. As a result, deflection of lever 13 by diaphragm assembly 17 is also eliminated thereby effecting pivotal movement of the lever about its pivoted end 25 to eliminate the force applied therefrom through adjusting stud 29 onto switch blade 3 for effecting generally conjoint actuation thereof. The compressive force of toggle spring 91 moves switch blade 3 in the counterclockwise direction (as seen in FIG. 3) past is overcenter position with characteristic snap-action breaking engagement of movable contact 89 with stationary contact 9 and making engagement of the movable contact with stationary contact 7. Such breaking and making engagement between movable contact 89 and stationary contacts 7, 9 opens branch circuit 21 de-energizing motor 133 and closes branch circuit 19 to effect energization of solenoid actuated switch 131, FIG. 4, Electrical switch 1 is now reset to effect refilling, as previously discussed, of tub 127 by solenoid valve 131 with water up to the mini-wash level previously selected by the operator.

Referring again in general to the drawings, there is illustrated a method for assembling condition responsive electrical device 1 so as to retain or mount pivot pin 65 against displacement from one of a pair of generally opposite surfaces 201, 203 of means, such as base wall 41 of housing 35, for supporting the pivot pin (FIGS. 1, 2, 5 and 6). In this method, pivot pin 65 is disposed on the one surface 201 between a pair of means, such as abutments 205, 207 for constraining movement of the pivot pin generally along its axis, and retainer 69 is inserted through supporting means or base wall 41 of housing 35. Means, such as tab 75, on retainer 69 is placed at least in overlaying relation with pivot pin 65 for generally maintaining it against displacement from its position on the one surface 201. Also, means, such as tab 77, on retainer 69 is positioned at least in overlaying relation with the other of the surfaces 203 for preventing displacement of the retainer from base wall 41 of housing 35.

More particularly and with specific reference to FIGS. 5 and 6 means, such as trunnion grooves 67, 68, are formed in surface 201 for rotatably receiving pivot pin 65 therein, and constraining means or abutments 205, 207, respectively are portions of the trunnion grooves defining opposed or facing ends or end walls thereof. Retainer 69 is formed from an elongate metallic piece or body in which the base or intermediate portion 71 thereof is integrally interposed between tabs 75, 77. Preferably tab 75 is deformed or bent from intermediate portion 71 of retainer 79 prior to the insertion thereof through slot 73 in housing base wall 41 so as to assemble tab 75 in overlaying relation with pivot pin 67. With retainer 69 inserted through slot 73 and tab 75 in overlaying relation with pivot pin 65, the retainer may be subsequently deformed by suitable means well known in the art (not shown) for forming displacement preventing means, such as tab 77, and thereby positioning it in overlaying relation with the other surface 203 on housing base wall 41.

It is contemplated as being within the scope of the invention to preform tab 77 on retainer 69 and insert it through slot 73 placing tab 77 in abutment with surface 203 so that the retainer may be subsequently deformed thereby to form or bend tab 75 placing it in overlaying relation with pivot pin 65. In this vein, it is also contemplated as being within the scope of the invention to insert retainer 69 through slot 73 and thereafter deform it to form or bend tabs 75, 77 placing them in overlaying relation with pivot pin 65 and surface 203 of housing base wall 41, respectively.

With pivot pin 65 so disposed on surface 201 against displacement, it may be noted that the pivot pin is generally loosely mounted within trunnion grooves 67, 68 for rotation therein to enhance the pivotal movement of lever 13 received thereon. Further, such generally loose mounting of pivot pin 65 in trunnion grooves 67, 68 reflects less critical tolerances for the fabrication of these components thereby to effect more economical manufacture and assembly. Of course, such more loose tolerances may be compensated by the utilization of adjusting stud 29 for adjustably effecting the desired tolerance relation between lever 13 and switch blade 3, as discussed hereinbefore. It may also be noted that the engagement of tab 77 with surface 203 maintains the overlaying relation of tab 75 with pivot pin 65. Further, it may also be noted that retainer 69 is freely mounted with tabs 75, 77 thereof maintaining the retainer as positioned against displacement from housing 35.

There is also shown in FIGS. 5 and 6 a mounting device 209 in one form of the invention for a pivotally mounted member, such as lever 13. In mounting device 209, means, such as pivot pin 65, is provided for pivotally mounting member or lever 13, and means, such as surface 201, is also provided for supporting the mounting means or pivot pin 65. A pair of means, such as abutments 205, 207, are provided for abutment with pivot pin 65 generally constraining its movement therebetween. Means, such as retainer 69, for displacement preventing engagement with pivot pin 65 includes means, such as tab 75, disposed generally in overlaying relation with the pivot pin for retaining it against displacement from the supporting means for surface 201. The displacement preventing engagement means or retainer 69 also extends through the supporting means and includes means, such as tab 77, extending into engagement with a portion of the supporting means, such as surface 203, for maintaining the overlying relation of the retaining means or tab 75 with respect to pivot pin 65.

More particularly, a recess 211 is provided in surface 201 of housing base wall 41 for receiving at least a portion of lever 13, i.e., the pivotal portion 25 thereof, and the recess has a pair of opposed side walls 213, 215 with a base wall 217 interposed therebetween. Trunnion grooves 67, 68 are provided in surface 201 of housing base wall 41 in aligned relation generally normal to recess 211 and respectively intersecting with sidewalls 213, 215 of recess 211. Each of trunnion grooves 67, 68 have an end disposed generally in facing relation with each other, and abutments 205, 207 generally constitute the ends of the trunnion grooves, respectively. Pivot pin 65 to which lever 13 is mounted, as previously mentioned, is disposed in trunnion grooves 67, 68 between ends thereof or abutments 205, 207 and extends across recess 211. Slot 73 extends through housing base wall 41 generally between base 217 of recess 211 and surface 203 of housing 35. Retainer 69 for the pivot pin includes intermediate portion 71 extending through slot 73 and having a pair of opposite end portions 219, 221. The pair of tabs 75, 77 are integrally formed on intermediate portion 71 adjacent opposite end portions 219, 221 thereof, respectively. Tab 75 extends from intermediate portion 71 into overlaying relation with pivot pin 65 between side walls 213, 215 of recess 211 thereby to prevent displacement of the pivot pin from trunnion grooves 67, 68. To complete the description of mounting device 209, tab 77 extends from intermediate portion 71 for abutting engagement with surface 203 of housing base wall 41.

From the foregoing, it is now apparent that a novel mounting device 209 in a condition responsive electrical device is presented meeting the objects and advantageous features set out hereinbefore, as well as others. Further, it is contemplated that changes as to the precise arrangements, shapes and details of the component parts of mounting device 209 may be made by those having ordinary skill in the art without departing from the spirit of the invention or scope thereof as set out by the claims which follow.

What I claim as new and desire to secure by Letters Patent of the United States is:

1. In a condition responsive electrical device having a housing, means movable in the housing between opposite positions for controlling a circuit through the device, means pivotally movable in the housing for effecting actuation of the controlling means, means for pivotally mounting the actuation means, means operable generally in response to the occurrence of a preselected condition for driving the actuation means to pivot it and conjointly move the controlling means toward one of its opposite positions, means selectively operable for biasing the actuation means against the driving means to also pivot the actuation means and effect conjoint movement of the controling means toward the other of its opposite positions, and a mounting device associated with the mounting means and the housing for the actuating means; the improvement wherein the mounting device comprises groove means in the housing for supporting the mounting means including an open side, and a pair of opposed means intersecting with said open side for abutment with the mounting means so as to generally constrain its movement therebetween, and means removably arranged with the housing for displacement preventing engagement with the mounting means including means disposed geneally in overlaying relation with the mounting means for retaining it against displacement from the open side of said groove means between said abutment means, and means integral with said retaining means and extending through the housing into engagement with an exterior portion thereof for maintaining the overlaying relation of said retaining means with respect to the mounting means.

2. In a condition responsive electrical device having a housing, a pivotally movable member, means for pivotally mounting the member in the housing, and a mounting device for the mounting means and associated with the housing, the improvement wherein the mounting device comprises groove means in the housing for supporting the mounting means and including a pair of means for abutment with the mounting means so as to generally constrain its movement therebetween, an open side of said groove means between said abutment means, and means removably arranged with the housing for displacement preventing engagement with the mounting means including means disposed generally in overlaying relation with the mounting means for retaining it against displacement from said open side of said groove means between said abutment means, and means extending through the housing and into engagement with an exterior portion thereof for maintaining the overlaying relation of said retaining means with respect to the mounting means.

3. The mounting device as set forth in claim 2 including a pair of spaced generally oppositely disposed surfaces on the housing, said groove means extending into one of said surfaces and said maintaining means being engaged with the other of said surfaces, said other surface being disposed on the exterior portion of the housing.

4. The mounting device as set forth in claim 2 wherein the mounting means comprises a pivot pin disposed in said groove means with said abutment means pair of said groove means generally limiting movement of the pivot pin generally along its axis.

5. The mounting device as set forth in claim 2 further comprising a slot in the housing arranged so as to extend generally between said groove means and the exterior portion of the housing and disposed generally adjacent the mounting means, said maintaining means extending through said slot.

6. The mounting device as set forth in claim 2 wherein said retaining means comprises a tab extending over at least a portion of said open side of said groove means into the overlaying relation with the mounting means wherein the mounting means is geneally loosely retained in said groove means.

7. In a condition responsive electrical device having a housing, an exterior surface on said housing, a pivotally movable member in said housing, a pivot pin associated with the member in the housing, and a mounting device for the pivot pin; the improvement wherein the mounting device comprises another surface within the housing and arranged in generally oppositely facing relation with respect to the exterior surface, a recess in said another surface for receiving at least a portion of the member and having a pair of opposed sidewalls with a base wall interposed therebetween, a pair of trunnion grooves in said another surface generally in aligned relation with each other and respectively intersecting with said sidewalls of said recess, each of said trunnion grooves including an open side and having an end extending from said open side, the pivot pin being disposed in said trunnion grooves between said respective ends thereof and extending across said recess, a slot in the housing extending generally between said base wall of said recess and the exterior surface of the housing, and a retainer for the pivot pin removably arranged with the housing including an intermediate portion extending through said slot and having a pair of opposite end portions, and a pair of tabs integrally formed on said intermediate portion and comprising said opposite end portions thereof, respectively, one of said tabs extending from said intermediate portion into overlaying relation with the pivot pin between said sidewalls of said recess thereby to prevent displacement of the pivot pin from said respective open sides of said trunnion grooves, and the other of said tabs extending from said intermediate portion exteriorly of the housing for abutting engagement with the exterior surface of the housing.

* * * * *

UNITED STATES PATENT AND TRADEMARK OFFICE

CERTIFICATE OF CORRECTION

PATENT NO. : 4,115,674

DATED : September 19, 1978

INVENTOR(S) : Stanley J. Budlane, Dann W. Denny, Ronald L. Hilty

It is certified that error appears in the above-identified patent and that said Letters Patent are hereby corrected as shown below:

Col. 2, line 17, delete "that" and insert --the--;
line 19, delete "devices" and insert --device--;
line 28, after "are" insert --simply designed--;
line 35, before "mounting" insert --A--;
line 37, delete "and" and insert --the--.
Col. 7, line 66, delete "lever" and insert --level--.
Col. 9, line 61, delete "siwtch" and insert --switch--.
Col. 11, line 46, after "6" insert --,--.
Col. 12, line 39, delete "for" and insert --or--;
line 44, delete "overlying" and insert --overlaying--.
Col. 13, line 33, delete "controling" and insert --controlling--;
line 56, delete "," and insert --;--.
Col. 14, line 29, delete "geneally" and insert --generally--.

Signed and Sealed this

*Thirteenth* Day of *March 1979*

[SEAL]

*Attest:*

RUTH C. MASON
*Attesting Officer*

DONALD W. BANNER
*Commissioner of Patents and Trademarks*